US009166300B2

(12) United States Patent
Taura

(10) Patent No.: US 9,166,300 B2
(45) Date of Patent: Oct. 20, 2015

(54) SLOT ANTENNA

(75) Inventor: Toru Taura, Tokyo (JP)

(73) Assignee: NEC Corporation, Tokyo (JP)

( * ) Notice: Subject to any disclaimer, the term of this patent is extended or adjusted under 35 U.S.C. 154(b) by 219 days.

(21) Appl. No.: 13/995,929

(22) PCT Filed: Oct. 27, 2011

(86) PCT No.: PCT/JP2011/006008

§ 371 (c)(1),
(2), (4) Date: Jun. 19, 2013

(87) PCT Pub. No.: WO2012/107976

PCT Pub. Date: Aug. 16, 2012

(65) Prior Publication Data

US 2013/0271333 A1 Oct. 17, 2013

(30) Foreign Application Priority Data

Feb. 9, 2011 (JP) ..... 2011-026066

(51) Int. Cl.
*H01Q 13/10* (2006.01)
*H01Q 5/357* (2015.01)

(52) U.S. Cl.
CPC ..... *H01Q 13/106* (2013.01); *H01Q 5/357* (2015.01); *H01Q 13/10* (2013.01)

(58) Field of Classification Search
CPC ..... H01Q 13/10; H01Q 13/106
USPC ..... 343/767
See application file for complete search history.

(56) References Cited

U.S. PATENT DOCUMENTS

| | | | | |
|---|---|---|---|---|
| 2004/0008146 | A1 | 1/2004 | Ikegaya et al. | |
| 2005/0012674 | A1* | 1/2005 | Takei | 343/767 |
| 2006/0050002 | A1* | 3/2006 | Wang et al. | 343/767 |
| 2008/0272972 | A1* | 11/2008 | Kanno et al. | 343/767 |
| 2010/0231477 | A1* | 9/2010 | Kuramoto et al. | 343/795 |

FOREIGN PATENT DOCUMENTS

| | | | |
|---|---|---|---|
| CN | 101075699 | A | 11/2007 |
| CN | 201075403 | Y | 6/2008 |
| JP | 5-110332 | | 4/1993 |
| JP | 2004-048119 | A | 2/2004 |

(Continued)

OTHER PUBLICATIONS

International Search Report (ISR) (PCT Form PCT/ISA/210), in PCT/JP2011/006008, dated Jan. 31, 2012.

(Continued)

*Primary Examiner* — Dameon E Levi
*Assistant Examiner* — Collin Dawkins
(74) *Attorney, Agent, or Firm* — McGinn IP Law Group, PLLC

(57) ABSTRACT

A slot antenna includes a dielectric substrate, a conductor surface provided on one of surfaces of the dielectric substrate, a slot formed by making a cut in the conductor surface, one end of the cut forming an opened end on an edge of the conductor surface, and a stub formed inside the slot, the stub being connected to one of opposing sides of the slot by using a connection part, in which the stub is formed in such a manner that a length of the connection part becomes longer than a distance between a side opposing to the side connected to the connection part and the stub.

15 Claims, 11 Drawing Sheets

(56) References Cited

FOREIGN PATENT DOCUMENTS

| | | | |
|---|---|---|---|
| JP | 2005-039394 | A | 2/2005 |
| WO | WO 2007/138959 | A1 | 12/2007 |

OTHER PUBLICATIONS

Chinese Office Action dated Aug. 13, 2014 with an English Translation thereof.

* cited by examiner

SLOT ANTENNA

TECHNICAL FIELD

The present invention relates to a slot antenna, in particular, a slot antenna whose resonance frequency is adjusted by using a stub.

BACKGROUND ART

In general, the length of a slot antenna disposed on a dielectric substrate needs to be one quarter of the wavelength of the used frequency. For example, when the frequency is 800 MHz, the length of the slot antenna is about 90 mm and thus is too large to be applied to a portable radio terminal in which the packaging space is severely limited.

As a technique for reducing an antenna in size, Patent literature 1 discloses a method for forming a capacitor at a slot end. The configuration for forming a capacitor at a slot end disclosed in Patent literature 1 makes it possible to shift the resonance frequency of the antenna widely by a small capacitance. For example, Patent literature 1 discloses a structure for forming a capacitor at a slot end by using a conductive projection. Further, Patent literature 1 discloses a structure for forming a capacitor at a slot end by disposing a chip capacitor at the slot end.

Further, Patent literature 2 discloses a configuration for adding an additional radiation conductor in a part of a radiation conductor that forms a slot inside a slot in order to dispose an antenna inside the housing of a portable terminal or the like and to make it possible to transmit/receive radio waves in a plurality of frequency bands by using one antenna.

CITATION LIST

Patent Literature

Patent literature 1: Japanese Unexamined Patent Application Publication. No. 5-110332

Patent literature 2: Japanese Unexamined Patent Application Publication. No. 2004-48119

SUMMARY OF INVENTION

Technical Problem

However, in the configuration for forming a capacitor at a slot end disclosed in Patent literature 1, the resonance frequency of the antenna could be widely changed due to a slight error in the loaded capacitance. Therefore, it is necessary to elaborately create a loaded capacitance with high accuracy. Specifically, in the configuration for forming a capacitor by using a conductive projection, there is a problem that the resonance frequency of the antenna could be deviated due to the variations in the mass production such as thickness variations of the dielectric substrate and relative dielectric constant variations. Further, in the configuration using a chip capacitor, there is a problem that the resonance frequency of the antenna could be deviated due to the capacitance variations of the chip capacitor itself.

Further, in the slot antenna disclosed in Patent literature 2, the specific shape and the like of the radiation conductor added inside the slot are not clearly described. Therefore, it is unclear whether or not the slot antenna can be actually reduced in size by adding the radiation conductor inside the slot.

To solve the problems like this, an object of the present invention is to provide a slot antenna capable of, when the slot antenna is reduced in size, adjusting the resonance frequency with high accuracy.

Solution to Problem

A slot antenna according to a first aspect of the present invention includes: a dielectric substrate; a conductor surface provided on one of surfaces of the dielectric substrate; a slot formed by making a cut in the conductor surface, one end of the cut forming an opened end on an edge of the conductor surface; and a stub formed inside the slot, the stub being connected to one of opposing sides of the slot by using a connection part, in which the stub is formed in such a manner that a length of the connection part becomes longer than a distance between a side opposing to the side connected to the connection part and the stub.

Advantageous Effects of Invention

According to the present invention, it is possible to provide a slot antenna capable of, when the slot antenna is reduced in size, adjusting the resonance frequency with high accuracy.

DESCRIPTION OF EMBODIMENTS

First Exemplary Embodiment

Figure 1:
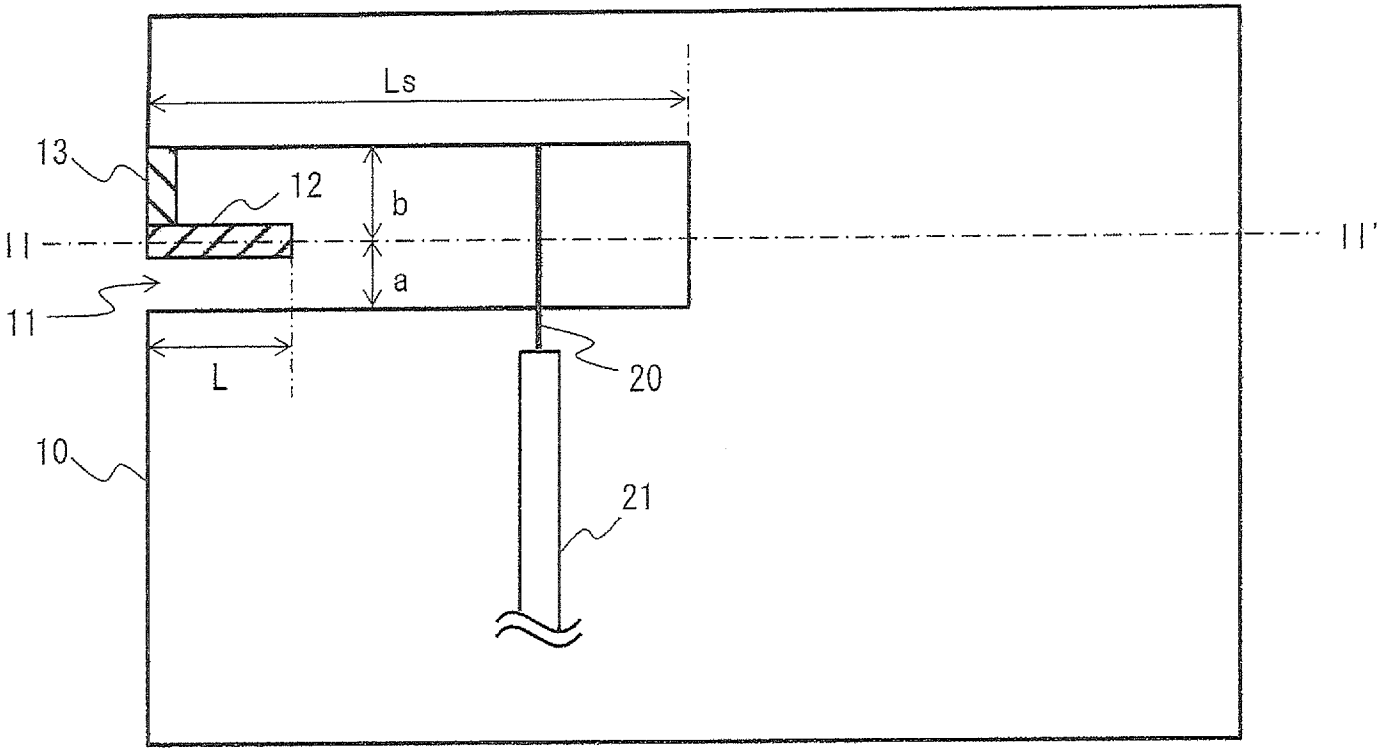
FIG. 1 is a configuration diagram of a slot antenna according to a first exemplary embodiment.
Figure 2:
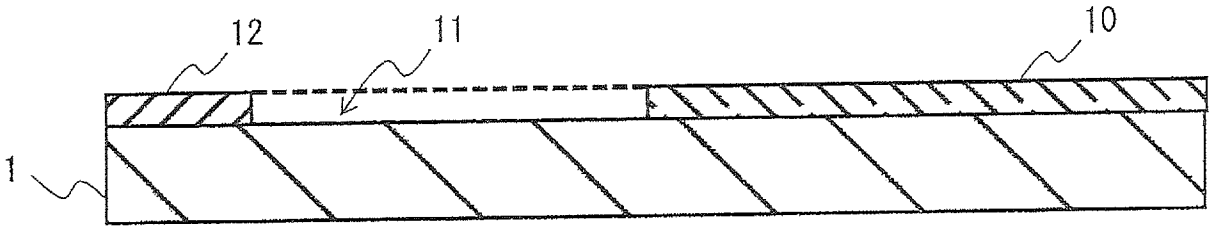
FIG. 2 is a cross section of a slot antenna according to a first exemplary embodiment.

Exemplary embodiments according to the present invention are explained hereinafter with reference to the drawings. FIG. 1 shows a stub disposed in a slot in a conductor surface of a slot antenna device according to a first exemplary embodiment of the present invention. FIG. 2 shows a general configuration of the slot antenna device according to the first exemplary embodiment of the present invention, and is a cross section taken along a line II-II' in FIG. 1.

The slot antenna device includes a plate-like dielectric substrate 1 made of dielectric, a conductor surface 10 provided on one of the surfaces (e.g., top surface) of the dielectric substrate 1, a slot 11 formed by making a cut in the conductor surface 10, and a stub 12 formed inside the slot 11. Further, one end of the cut forms an opened end on the edge of the conductor surface 10, and the stub 12 is connected to one of opposing sides of the slot by using a connection part 13. Each of an external conductor of a feeder 21 and a feeding part 20, i.e., an internal conductor of the feeder 21 is connected to the conductor surface 10 on both sides of the slot 11 in such a manner that they are connected across the slot 11. A radio circuit (not shown) feeds electricity to the slot 11 through the feeder 21 and the feeding part 20.

The slot 11 is formed in such a manner that one end is an opened end and the other end is a short-circuited end, and the length of the slot 11 is represented by Ls. When a wavelength corresponding to a used frequency is represented by λ, the slot 11 resonates at a frequency at which the length Ls is equal to λ/4. The slot 11 has a straight-line shape, and one of the opposing sides of the slot 11 is connected to the stub 12 by using the connection part 13.

The stub 12 is a plate-like member having a narrow straight-line shape. The length L of the stub 12 (stub length) is adjusted so that, when a wavelength corresponding to a used frequency is represented by λ, the relation "L<λ/4" is satisfied. Further, the width of the stub 12 is substantially small in comparison to the stub length L. One end of the stub 12 is connected to one of the opposing sides of the slot 11 having a straight-line shape through the connection part 13. The other end of the stub 12 forms an opened end. Therefore, the stub 12 forms an opened-end type stub. FIG. 1 shows an example in which the stub 12 is connected near the opened end of the slot 11. All of the conductor surface 10, the stub 12, and the connection part 13 may be conductors that are formed by using similar material.

The slot antenna explained above with reference to FIGS. 1 and 2 is configured so that the stub length L of the stub 12 disposed at the opened end of the slot 11 satisfies the relation "L<λ/4". This configuration is equivalent to a state where a capacitance is loaded at the opened end of the slot 11, and the resonance frequency of the slot antenna is shifted to the low frequency side. As a result, it is possible to reduce the slot in size. Note that the value of the capacitance generated by the stub 12 is determined mainly by the stub length L. Therefore, the capacitance value generated by the stub 12 is hardly affected by the thickness of the dielectric substrate 1 and the relative dielectric constant of the dielectric forming the dielectric substrate 1.

Note that when a distance between the stub 12 and the side of the slot 11 that is not connected to the connection part 13 is represented by "a" and the length of the connection part 13 is represented by "b", the stub 12 needs to be disposed in such a manner that the distance "a" becomes shorter than the length "b". By disposing the stub 12 in the above-described position and adjusting the stub length L to satisfy the relation "L<λ/4" as described above, a necessary capacitance for shifting the resonance frequency to the low frequency side is added in the slot 11. Further, the amount of this shift can be controlled by adjusting the stub length L.

Figure 3:
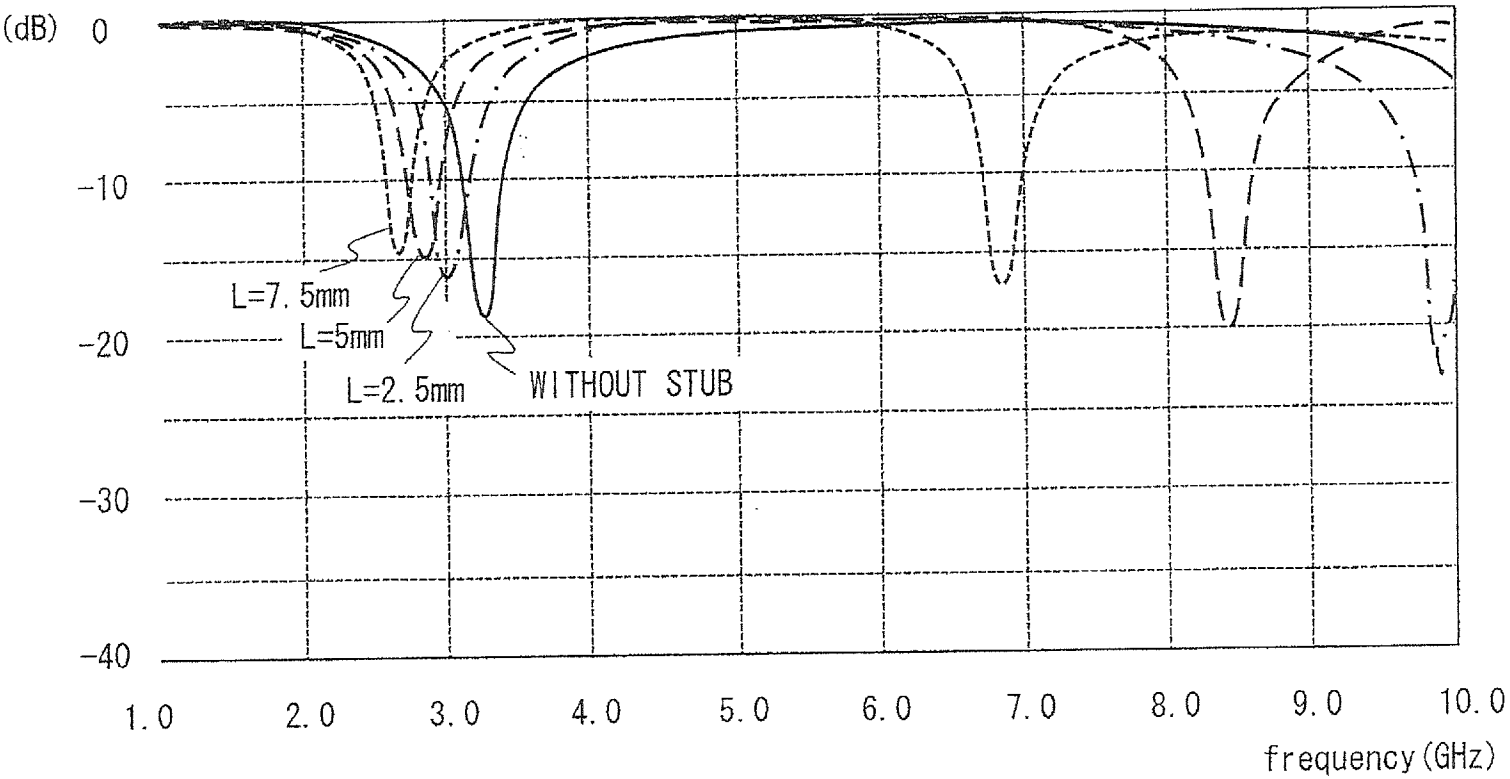
FIG. 3 shows a calculation example of an impedance characteristic of a slot antenna device according to a first exemplary embodiment.

Next, a calculation example of an impedance characteristic of the slot antenna device according to this first exemplary embodiment is explained with reference to FIG. 3. When the stub length L of the opened-end type stub 12 shown in FIG. 1 is changed over a range between 0 mm and 7.5 mm, the impedance characteristic of the slot antenna device is changed as shown in FIG. 3. That is, by increasing the stub length L, the resonance frequency is shifted to the low frequency side. In this calculation example, the distance "a" is sufficiently shorter than the length "b". That is, the calculation was carried out on the condition that "a=0.25 mm" and "b=1.25 mm".

By changing the stub length L and thereby controlling the capacitance to be loaded at the opened end of the slot 11 in this manner, it is possible to adjust the resonance frequency of the slot antenna device with high accuracy without changing the size of the slot 11. That is, it is possible to achieve a desired antenna resonance frequency by using a slot 11 having a smaller size.

As explained above, the slot antenna device according to the first exemplary embodiment of the present invention has such a configuration that the capacitance to be loaded in the slot antenna device is controlled by adjusting the stub length L of the stub 12. Therefore, it is possible to reduce the effect to the resonance frequency of a slot antenna device resulting from the variations in the thickness of the dielectric substrate 1 and the variations in the relative dielectric constant of the dielectric and thereby to adjust the resonance frequency with high accuracy.

Further, since the conductor pattern(s) of the stub 12 and the connection part 13 can be formed by using an ordinary printed-circuit board manufacturing process, the variations in the stub length L can be kept at a very small level. As a result, the resonance frequency of the slot antenna device can be controlled with high accuracy.

Further, the slot antenna device does not need to use any chip capacitor to control the capacitance. Therefore, the cost of the slot antenna device can be reduced because of the smaller number of necessary components.

Second Exemplary Embodiment

Figure 4:
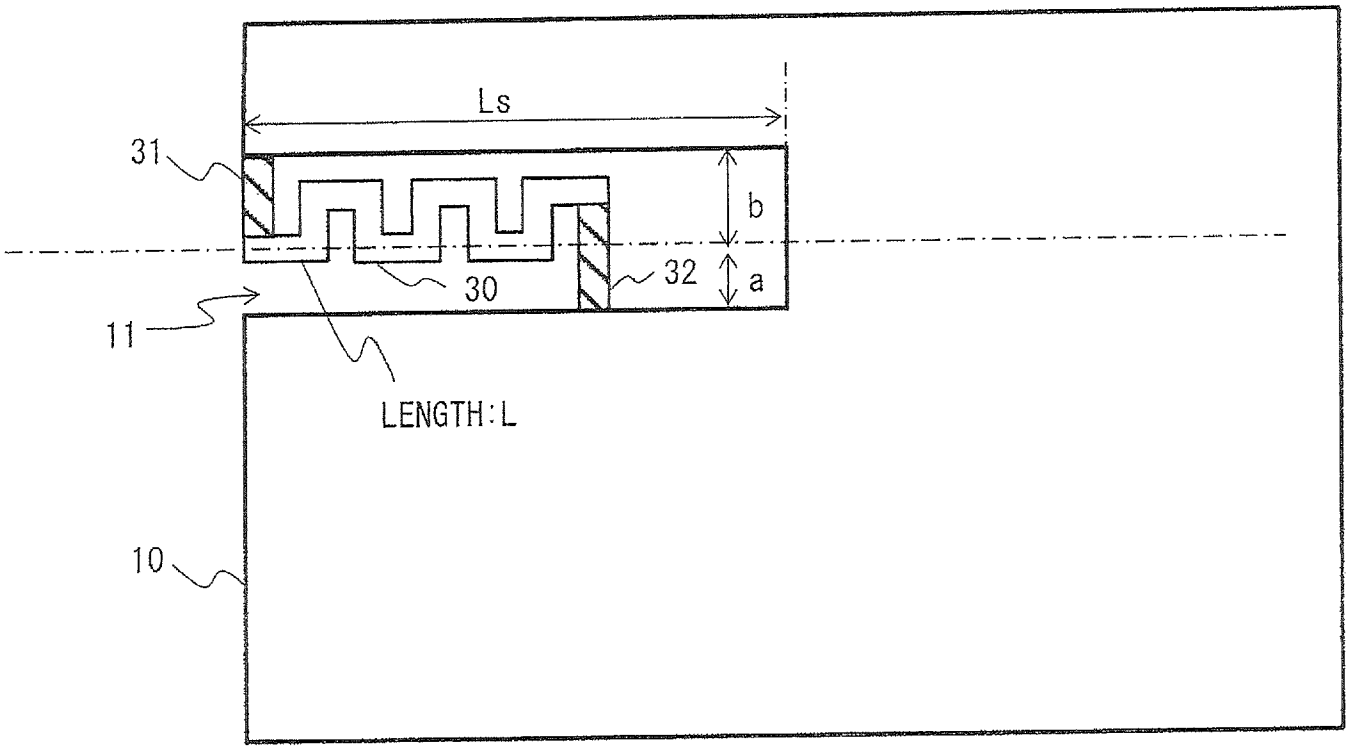
FIG. 4 is a configuration diagram of a slot antenna according to a second exemplary embodiment.

FIG. 4 shows a stub disposed in a slot in a conductor surface of a slot antenna device according to a second exemplary embodiment of the present invention. In the slot antenna device according to this second exemplary embodiment, one end of a stub 30 is connected to the conductor surface 10 near the opened end of the slot 11 through a connection part 31. Further, the other end of the stub 30 is connected to the side opposing to the side connected to the connection part 31 through a connection part 32. The stub 30 shown in FIG. 4 is a short-circuited-end type stub in which the other end is short-circuited to the conductor surface 10. Further, the stub 30 shown in FIG. 4 is formed in a meandering shape. The stub 30 formed in a meandering shape is configured so that the stub length L satisfies a relation "λ/4<L<λ/2". The other configuration of the slot antenna device according to this second exemplary embodiment is roughly the same as that of the slot antenna device according to the above-described first exemplary embodiment. Therefore, the same symbols are assigned to the same parts and their detailed explanation is omitted. Further, assume that a feeder and a feeding part are also connected in a similar manner to those of the first exemplary embodiment.

When the slot antenna device having the above-described configuration is configured so that the stub length L of the stub 30 disposed inside the slot 11 satisfies the relation "λ/4<L<λ/2", it becomes equivalent to a state where a capacitance is loaded at the opened end of the slot 11. Therefore, the resonance frequency of the slot antenna device is shifted to the low frequency side.

Further, assume that the length of the connection part 31 connected to the opened end of the slot 11 is "b" and that the shortest distance between the side opposing to the side connected to the connection part 31 and the stub 30 is "a". In this case, the stub 30 is disposed so that the distance "a" becomes smaller than the length "b". By disposing the stub 30 in the above-described position and adjusting the stub length L to satisfy the relation "$\lambda/4<L<\lambda/2$" as described above, a necessary capacitance for shifting the resonance frequency to the low frequency side is added in the slot 11. Further, the amount of this shift can be controlled by adjusting the stub length L.

Therefore, similarly to the slot antenna device according to the above-described first exemplary embodiment, it is also possible in the slot antenna device according to this second exemplary embodiment to adjust the resonance frequency of the slot antenna device with high accuracy by changing the stub length L and thereby controlling the capacitance to be loaded at the opened end of the slot 11 without changing the size of the slot 11. That is, it is possible to achieve a desired resonance frequency by using a slot 11 having a smaller size.

Further, similarly to the slot antenna device according to the above-described first exemplary embodiment, the capacitance value generated by the stub 30 in the slot antenna device according to this second exemplary embodiment is determined by the stub length L and thus hardly affected by the thickness of the dielectric substrate 1 and the relative dielectric constant of the dielectric. Further, the conductor pattern(s) that forms the stub 30 and the connection parts 31 and 32 can be formed by using an ordinary printed-circuit board manufacturing process. Therefore, the variations in the stub length L can be kept at a very small level. That is, it is possible to reduce the variations in the capacitance generated by the stub 30 and thereby to control the resonance frequency with high accuracy.

Note that the shape of the stub 30 is not limited to the meandering shape. That is, the stub 30 may have a spiral shape, a folded shape, an irregularly-meandering shape, or the like.

Third Exemplary Embodiment

Figure 5:
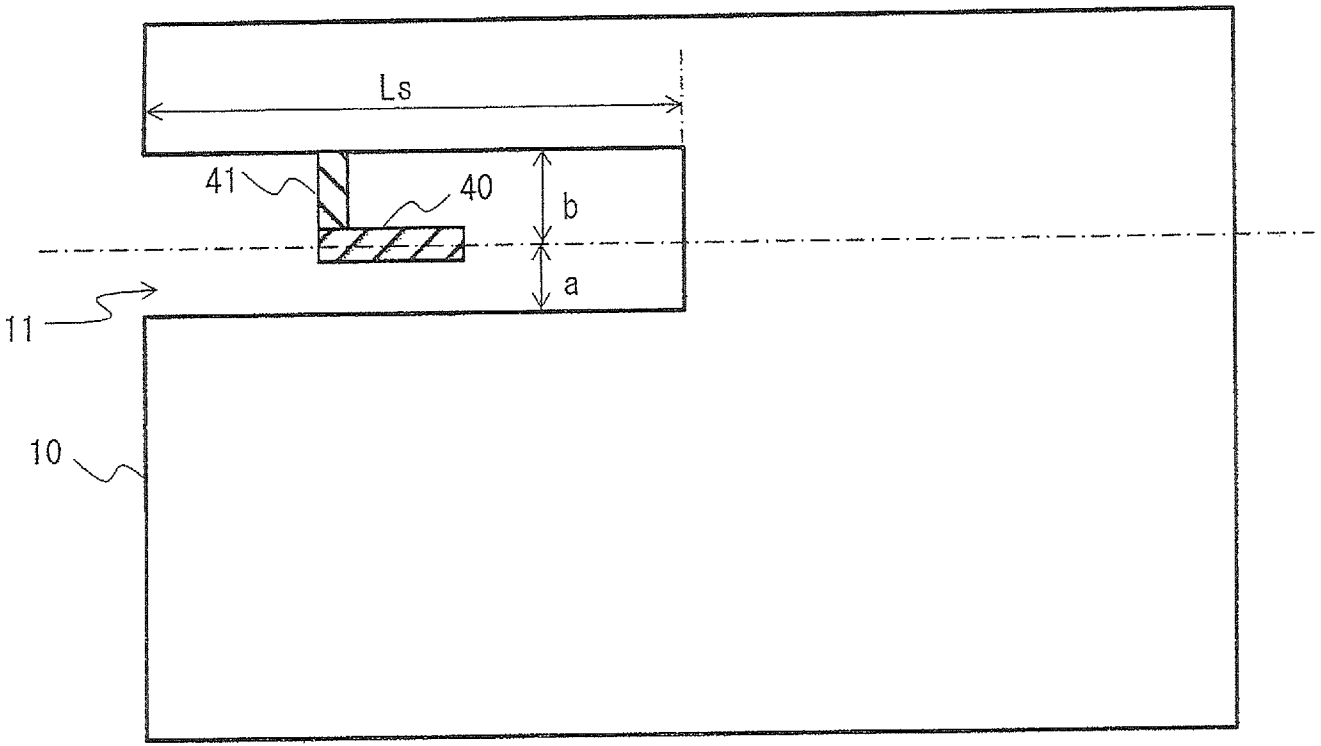
FIG. 5 is a configuration diagram of a slot antenna according to a third exemplary embodiment.

FIG. 5 shows a stub disposed in a slot in a conductor surface of a slot antenna device according to a third exemplary embodiment of the present invention. In the slot antenna device according to this third exemplary embodiment, a stub 40 is connected to the dielectric substrate 1 through a connection part 41 in such a manner that the stub 40 is positioned on the inner side with respect to the slot opened end. The configuration other than the stub 40 and the connection part 41 is similar to that of the slot antenna according to the first exemplary embodiment. In the slot antenna device according to the third exemplary embodiment, the shift amount of the antenna resonance frequency to the low frequency side decreases as the distance between the stub position and the opened end of the slot 11 increases. The stub position of the slot antenna device according to this third exemplary embodiment is adjusted based on this fact, and this enables a fine adjustment of the resonance frequency.

Figure 6:
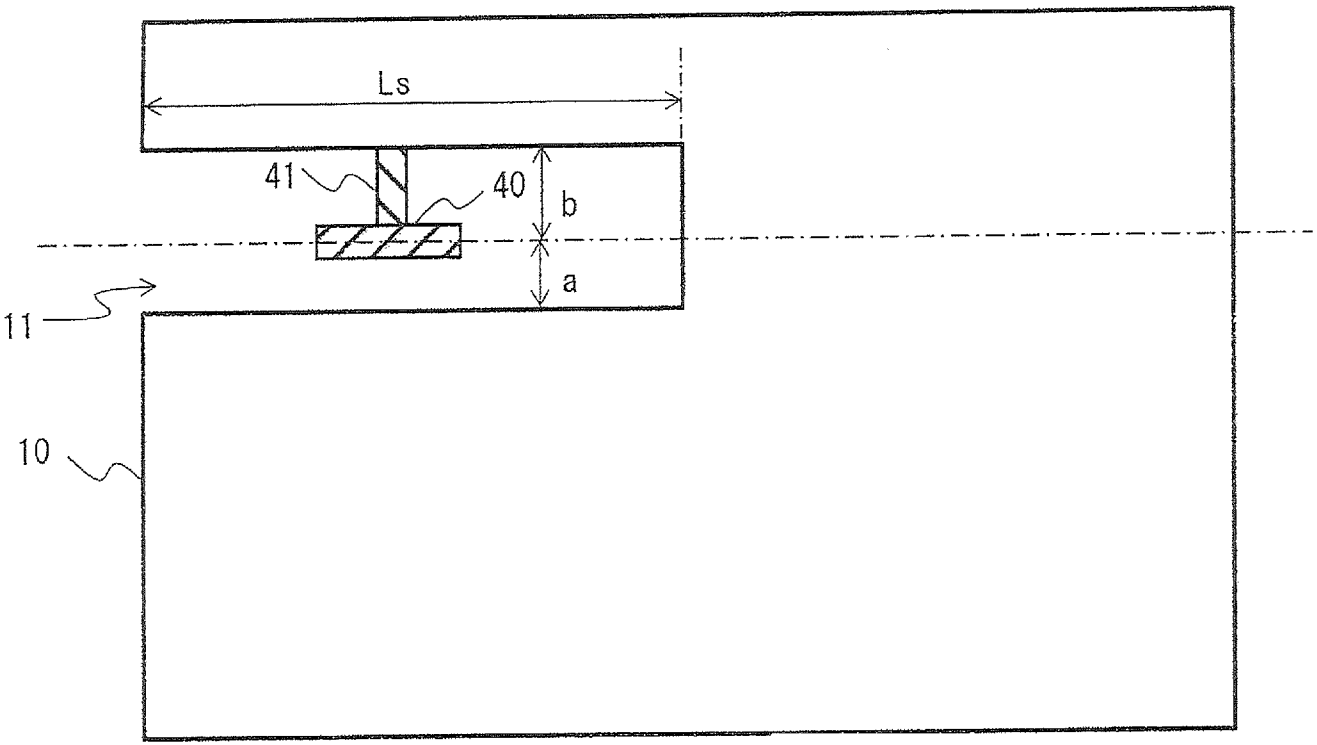
FIG. 6 is a configuration diagram of a slot antenna according to a third exemplary embodiment.

Further, although the stub 40 and the connection part 41 shown in FIG. 5 have an L-shape, the shape of the stub 40 and the connection part 41 is not limited to this shape. Similarly, the shape of the stub 12 and the connection part 13 shown in FIG. 1 is not limited to an L-shape. The stub 40 and the connection part 41 may have any shape, provided that one end of the stub 40 is an opened end and the other end is connected to the dielectric substrate 1 through the connection part 41. For example, as shown in FIG. 6, the stub 40 and the connection part 41 may have a T-shape. Further, although the opened end of the stub 40 is located on the inner side of the slot 11 with respect to the connection part 41 in FIG. 5, the stub 40 and the connection part 41 may have such a shape that the opened end of the stub 40 is located on the opened-end side of the slot 11 with respect to the connection part 41. Further, the stub 40 may have a meandering shape, a folded shape, or an irregularly-meandering shape.

Fourth Exemplary Embodiment

Figure 7:
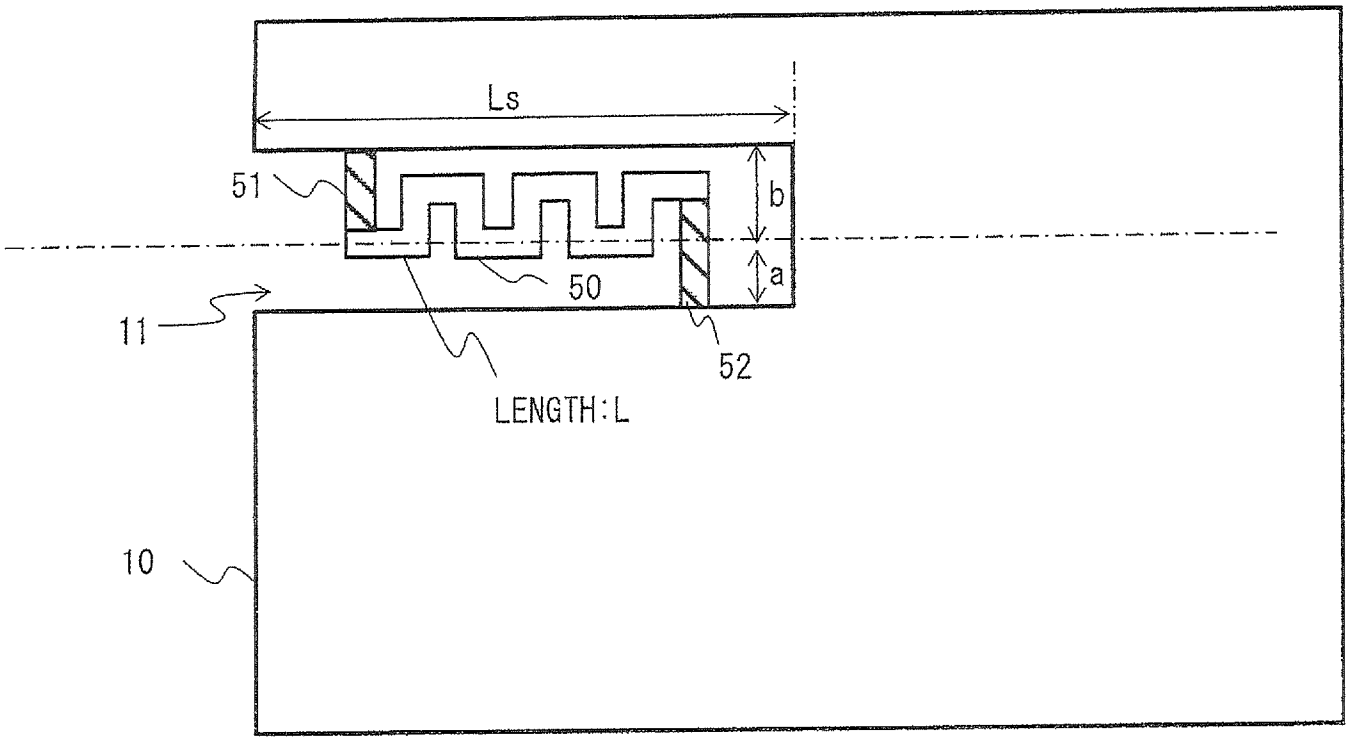
FIG. 7 is a configuration diagram of a slot antenna according to a fourth exemplary embodiment.

FIG. 7 shows a stub disposed in a slot in a conductor surface of a slot antenna device according to a fourth exemplary embodiment of the present invention. In the slot antenna device according to this fourth exemplary embodiment, a stub 50 formed in a meandering shape is connected to the dielectric substrate 1 through connection parts 51 and 52 in such a manner that the stub 50 is located on the inner side with respect to the slot opened end. The configuration other than the stub 50 and the connection parts 51 and 52 is similar to that of the slot antenna according to the second exemplary embodiment. In the slot antenna device according to the fourth exemplary embodiment, the shift amount of the antenna resonance frequency to the low frequency side decreases as the distance between the stub position and the opened end of the slot 11 increases. By this feature, in the slot antenna device according to this fourth exemplary embodiment, the stub position adjustment enables a fine adjustment of the resonance frequency.

Further, although the stub 50 and the connection parts 51 and 52 shown in FIG. 7 have a meandering shape, the shape of the stub 50 and the connection parts 51 and 52 is not limited to this shape. The connection parts 51 and 52 may have any shape, provided that the connection part 51 is connected to one side of the slot 11 and the connection part 52 is connected to the side opposing to the side connected to the connection part 51. For example, the stub 50 may have a folded shape or an irregularly-meandering shape.

Fifth Exemplary Embodiment

Figure 8:
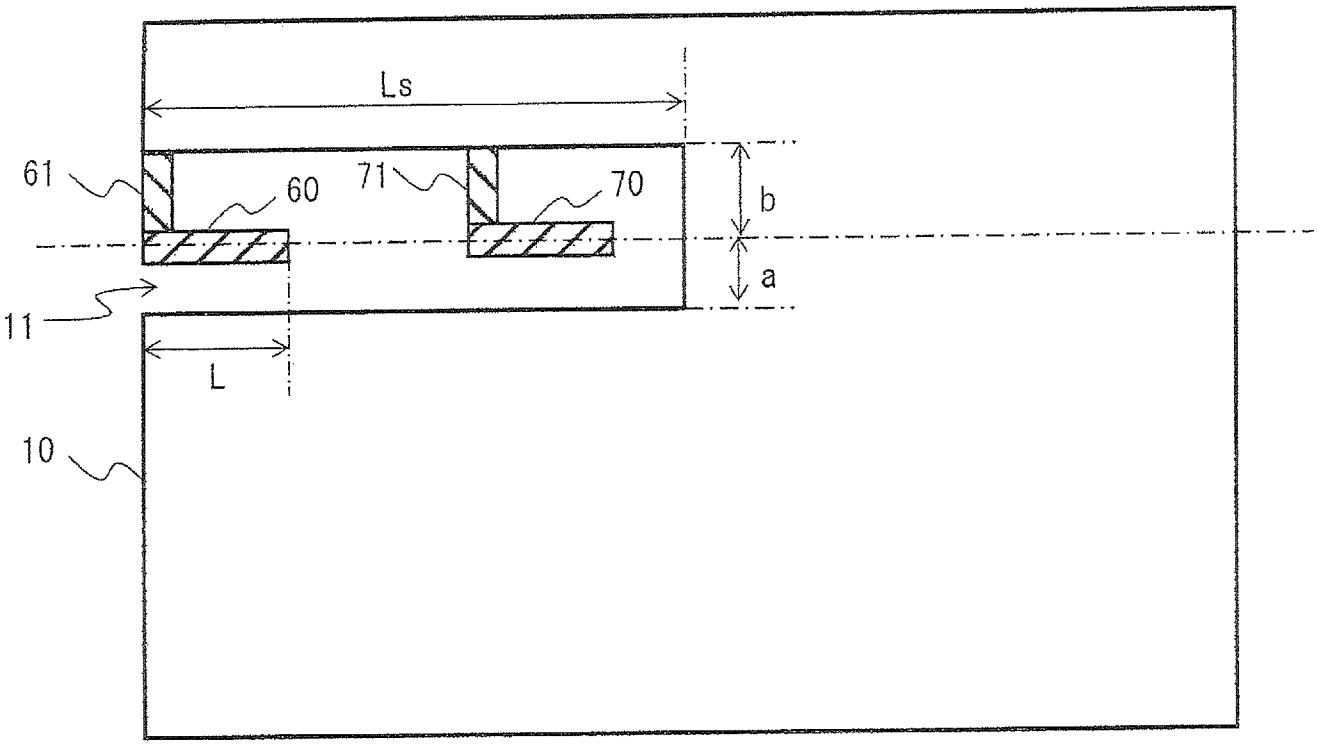
FIG. 8 is a configuration diagram of a slot antenna according to a fifth exemplary embodiment.

FIG. 8 shows a stub disposed in a slot in a conductor surface of a slot antenna device according to a fifth exemplary embodiment of the present invention. In the slot antenna device according to this exemplary embodiment, an opened-end type stub 70 is further disposed inside the slot 11 in addition to an opened-end type stub 60 disposed at the opened end of the slot 11. Further, the stub 70, which is disposed inside the slot 11, is disposed at a position $\lambda/2$ away from the opened end of the slot 11.

The electric field of a slot antenna in a resonance frequency 1 corresponding to a state where the slot length is one quarter of the wavelength has such a standing wave distribution that the electric field at the opened end of the slot 11 becomes an anti-node and the electric field at the short-circuited end side becomes a node. In contrast to this, the electric field of a slot antenna in a resonance frequency 2 corresponding to a state where the slot length is three quarters of the wavelength has such a standing wave distribution that the electric fields at the opened end of the slot 11 and a position $\lambda/2$ away from the opened end of the slot 11 become an anti-node and the electric fields at a position $\lambda/4$ away from the opened end of the slot 11 and a position $3\lambda/4$ away from the opened end become a node.

Note that when the stub 60 and the stub 70 are disposed at the opened end of the slot 11 and a position $\lambda/2$ away from the opened end of the slot 11, respectively, at which the standing wave distribution becomes an anti-node, the following effects are obtained. Both of the resonance frequencies 1 and 2 can be changed by adjusting the stub length of the stub 60 disposed at the opened end of the slot 11. Further, only the resonance frequency 2 can be changed by adjusting the stub length of the stub 70 disposed at the position λ/2 away from the opened end of the slot 11.

Therefore, in this fifth exemplary embodiment, firstly, the resonance frequency 1 is adjusted to a desired resonance frequency by controlling the stub length of the stub 60 disposed at the opened end of the slot 11. Then, the resonance frequency 2 is adjusted to a desired resonance frequency by controlling the stub length of the stub 70 disposed at the position λ/2 away from the opened end of the slot 11. Since the resonance frequency(s) of the slot antenna device according to the fifth exemplary embodiment can be adjusted in this manner, it is possible to produce multiple resonances by using only one slot without changing the size of the slot length. As a result, it is possible to achieve a substantial reduction of the antenna in size.

Further, it is possible to independently adjust a plurality of resonance frequencies by disposing a plurality of stubs at appropriate positions and independently controlling each stub length. As a result, it is possible to curtail the frequency adjustment process.

Further, although an example in which two stubs are disposed is explained in this fifth exemplary embodiment, the number of stubs is not limited to two. Further, although an example in which opened-end type stubs are used is explained in this fifth exemplary embodiment, a plurality of short-circuited-end type stubs may be disposed.

Sixth Exemplary Embodiment

Figure 9:
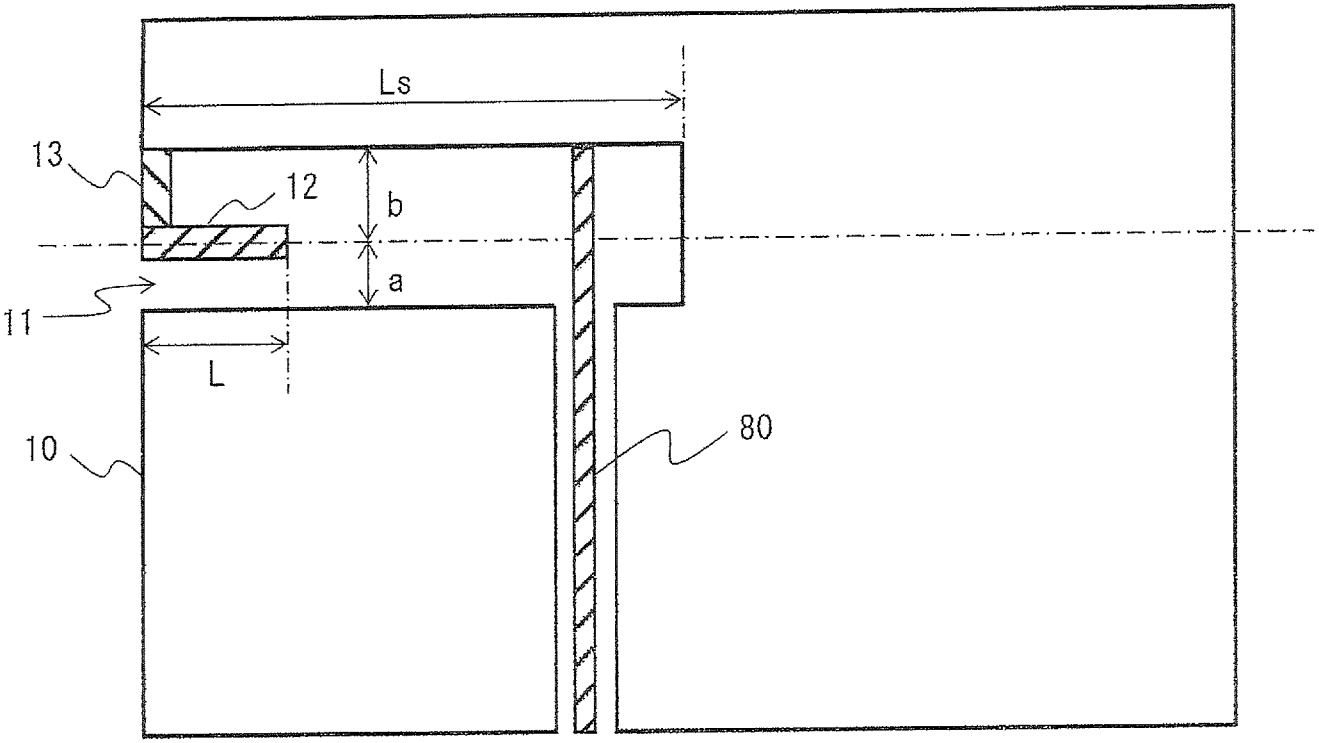
FIG. 9 is a configuration diagram of a slot antenna according to a sixth exemplary embodiment.
Figure 10:
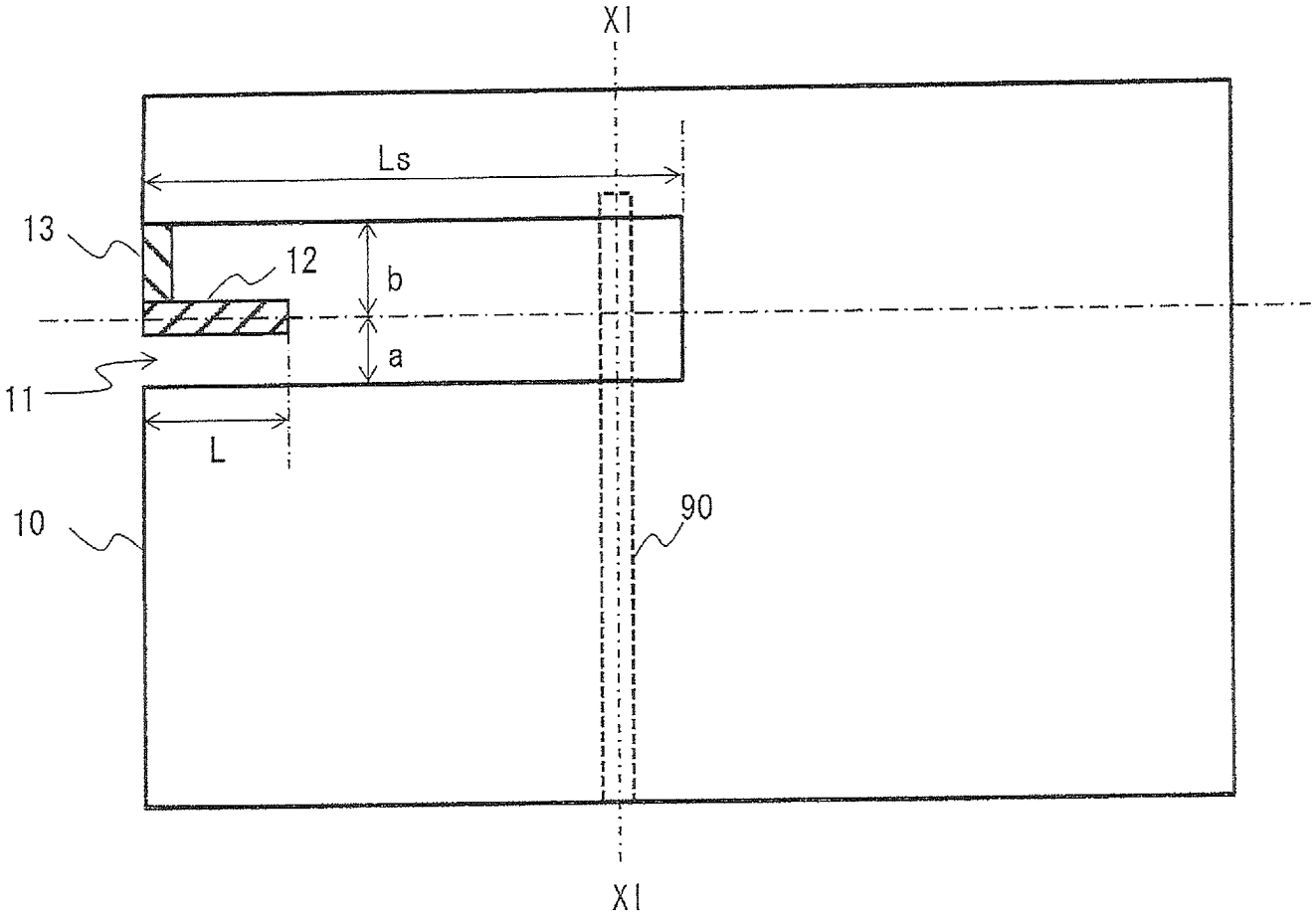
FIG. 10 is a configuration diagram of a slot antenna according to a sixth exemplary embodiment.
Figure 11:
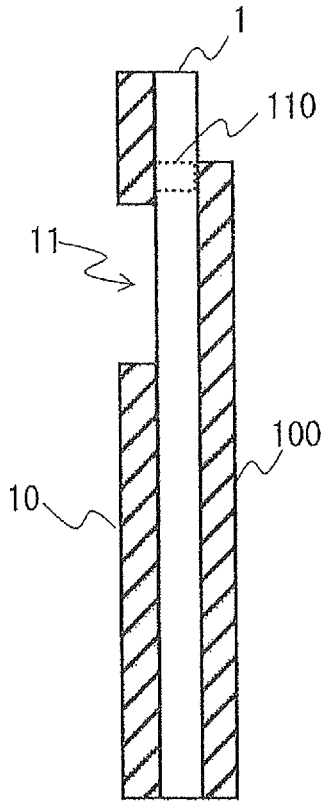
FIG. 11 is a configuration diagram of a slot antenna according to a sixth exemplary embodiment.

FIG. 9 shows a configuration of a feeder of a slot antenna device according to a sixth exemplary embodiment of the present invention. The slot antenna device according to this sixth exemplary embodiment has a similar configuration to that of the slot antenna device according to the first exemplary embodiment except that a coplanar type feeder 80 is used for the feeder of the slot antenna device according to the first exemplary embodiment. Further, FIG. 10 shows a slot antenna device in which a micro-strip type feeder 90 is used for the feeder. FIG. 11 is a cross section of the slot antenna device shown in FIG. 10, taken along a line XI-XI in FIG. 10. In the slot antenna device according to FIGS. 10 and 11, a conductor surface 10 is formed on one of the surfaces of the dielectric substrate 1 and a conductor surface 100 is formed on the other surface. Further, a through hole 110 is formed in the dielectric substrate 1 and the conductor surface 10 and the conductor surface 100 are electrically connected through the through hole 110.

In the slot antenna shown in this sixth exemplary embodiment, both the feeder and the radio circuit can be formed on one printed-circuit board. Therefore, it is possible to reduce the packaging space. Further, since there is no need to wire the feeder cable, it is possible to prevent electromagnetic interference between the feeder cable and other circuits/functional components, undesired radiation, radio performance deterioration due to the power loss, or the like caused by the feeder cable. Further, as for the cost, it is possible to reduce the cost in the antenna production.

Note that the present invention is not limited to the above-described exemplary embodiments, and modifications can be made as appropriate without departing the spirit and scope of the present invention.

Although the present invention is explained above with reference to exemplary embodiments, the present invention is not limited to the description above. Various modifications that can be understood by those skilled in the art can be made to the configuration and details of the present invention within the scope of the invention.

This application is based upon and claims the benefit of priority from Japanese patent application No. 2011-026066, filed on Feb. 9, 2011, the disclosure of which is incorporated herein in its entirety by reference.

REFERENCE SIGNS LIST

1 DIELECTRIC SUBSTRATE
10 CONDUCTOR SURFACE
11 SLOT
12 STUB
13 CONNECTION PART
20 FEEDING PART
21 FEEDER
30 STUB
31 CONNECTION PART
32 CONNECTION PART
80 COPLANAR TYPE FEEDER
90 MICRO-STRIP TYPE FEEDER
100 CONDUCTOR SURFACE
110 THROUGH HOLE

The invention claimed is:

1. A slot antenna comprising:
a dielectric substrate;
a conductor surface provided on one of surfaces of the dielectric substrate;
a rectangular-shaped slot formed by making a cut in the conductor surface, and including first and second long sides, and a short side forming an opened end on an edge of the conductor surface;
a stub formed inside the slot and connected to a connection part, the connection part being connected perpendicularly to the first long side of the slot; and
a feeder connected to the conductor surface on the first and second long sides of the slot such that the feeder is connected across the slot,
wherein the connection part is formed such that a length of the connection part becomes longer than a perpendicular distance between the second long side and the stub.

2. The slot antenna according to claim 1, wherein the stub comprises an opened-end type stub, one end of the stub being connected to the first long side of the slot by using the connection part, and another end of the stub being in an opened state, and
a length of the stub is shorter than one quarter of a wavelength corresponding to a used frequency.

3. The slot antenna according to claim 2, wherein one end of the stub is connected at the opened end of the slot by using the connection part.

4. The slot antenna according to claim 1, wherein one end of the stub is connected to the first long side of the slot by using the connection part,
another end of the stub is connected to the second long side of the slot by using an other connection part, and
the connection part is connected on an opened end side with respect to the other connection part.

5. The slot antenna according to claim 4, wherein a length of the stub is longer than one quarter of a wavelength corresponding to a used frequency and shorter than one half of the wavelength.

6. The slot antenna according to claim 1, wherein a plurality of stubs are disposed inside the slot.

7. The slot antenna according to claim 6, wherein the stub is disposed at a position a predetermined distance away from the opened end of the slot, the predetermined distance being n/2 times (n is integer) as long as a wavelength corresponding to a used frequency.

8. The slot antenna according to claim 1, wherein the feeder comprises a coaxial cable, a coplanar type feeder, or a microstrip type feeder.

9. The slot antenna according to claim 1, wherein the connection part and the stub are integrally formed with a printed-circuit board formed on the conductor surface.

10. The slot antenna according to claim 1, wherein the stub extends from the connection part in a lengthwise direction which is substantially parallel to the first and second long sides of the slot.

11. The slot antenna according to claim 1, wherein the stub comprises a plate-shaped member.

12. The slot antenna according to claim 1, wherein the conductor surface comprises a rectangular-shaped conductor surface including first and second long sides, and a short side which includes the opened end of the rectangular-shaped slot.

13. The slot antenna according to claim 12, wherein the first and second long sides of the slot are substantially parallel to the first and second long sides of the conductor surface.

14. The slot antenna according to claim 12, wherein the connection part extends in a lengthwise direction which is substantially parallel to the short side of the conductor surface.

15. A slot antenna comprising:

a conductor formed on a substrate;

a rectangular-shaped slot formed in the conductor and including first and second long sides, and a short side comprising an opening at an edge of the conductor surface;

a stub formed inside the slot;

a connection part connected to the stub and connected perpendicularly to the first long side of the slot; and a feeder connected to the conductor on the first and second long sides of the slot such that the feeder is connected across the slot, wherein a length of the connection part is greater than a perpendicular distance between the second long side and the stub.

* * * * *